US008534718B2

(12) United States Patent
Loret de Mola

(10) Patent No.: US 8,534,718 B2
(45) Date of Patent: Sep. 17, 2013

(54) TWO ASSEMBLY PARTS LATCH SYSTEM

(75) Inventor: Manuel Loret de Mola, Jupiter, FL (US)

(73) Assignees: The Young Engineers, Inc., Lake Forest, CA (US); Applied Concepts Aircraft Solutions, Inc., Stuart, FL (US)

( * ) Notice: Subject to any disclaimer, the term of this patent is extended or adjusted under 35 U.S.C. 154(b) by 71 days.

(21) Appl. No.: 13/229,090

(22) Filed: Sep. 9, 2011

(65) Prior Publication Data

US 2012/0013134 A1 Jan. 19, 2012

Related U.S. Application Data

(62) Division of application No. 12/384,064, filed on Mar. 31, 2009.

(51) Int. Cl.
*E05C 1/12* (2006.01)
*E05C 1/02* (2006.01)

(52) U.S. Cl.
USPC ..... 292/173; 292/165; 292/170; 292/191; 292/336.3; 292/DIG. 27; 292/DIG. 31; 292/DIG. 37; 70/208

(58) Field of Classification Search
USPC ..... 292/128, 223, 333, 23, 57–61, 63, 292/64, 66, 137, 143, 156, 161, 164, 169, 292/173, DIG. 31, DIG. 38, DIG. 29, DIG. 30, 292/DIG. 57, DIG. 64, 113, 139, 153, 166, 292/167, 169.17, 169.19, 170, 192, 226, 292/DIG. 27, DIG. 37, DIG. 71, 165, 191, 292/336.3; 70/81, 192, 208, 149, 207, 218, 70/221–224, 489, DIG. 31
See application file for complete search history.

(56) References Cited

U.S. PATENT DOCUMENTS

| | | | | |
|---|---|---|---|---|
| 107,773 | A | 9/1870 | Greenwood | |
| 122,061 | A | 12/1871 | Roble | |
| 161,705 | A * | 4/1875 | Robinson | 292/191 |
| 478,556 | A | 7/1892 | Bettmann | |
| 529,388 | A | 11/1894 | Johnston | |
| 1,111,235 | A | 9/1914 | Redin | |
| 1,256,992 | A * | 2/1918 | Edgar et al. | 292/167 |
| 1,257,998 | A | 3/1918 | Gruber | |
| 1,270,288 | A | 6/1918 | Gruber | |
| 1,746,273 | A * | 2/1930 | Neely | 200/61.78 |
| 1,965,939 | A * | 7/1934 | Jacobi | 70/81 |
| 1,989,801 | A * | 2/1935 | Halinka | 49/503 |
| 1,995,338 | A * | 3/1935 | Andrews | 70/489 |
| 2,055,688 | A * | 9/1936 | Halinka | 292/153 |
| 2,201,444 | A * | 5/1940 | Marsh | 292/165 |
| 2,247,937 | A | 7/1941 | Bittorf et al. | |
| 2,573,061 | A | 10/1951 | Raymond | |
| 2,649,322 | A * | 8/1953 | Mack | 292/173 |
| 2,764,440 | A * | 9/1956 | Marko | 292/173 |
| 2,893,773 | A * | 7/1959 | Clifton, Jr. | 292/223 |
| 3,090,643 | A * | 5/1963 | Barnes, Sr. | 292/170 |

(Continued)

FOREIGN PATENT DOCUMENTS

EP 0802345 A2 10/1997

*Primary Examiner* — Carlos Lugo
*Assistant Examiner* — Alyson M Merlino
(74) *Attorney, Agent, or Firm* — Joseph E. Mueth

(57) ABSTRACT

The combination of an actuator housing assembly and a bolt mechanism assembly adapted to enable attachment and detachment, the assemblies being carried on opposed sides of a panel. The bolt mechanism assembly comprises a sliding bolt assembly one element of which is adapted to latch to a striker.

6 Claims, 26 Drawing Sheets

(56) References Cited

U.S. PATENT DOCUMENTS

| | | | | | |
|---|---|---|---|---|---|
| 3,495,862 | A | * | 2/1970 | McClintock | 292/173 |
| 3,659,886 | A | | 5/1972 | Andrews | |
| 3,707,862 | A | * | 1/1973 | Pastva, Jr. | 70/150 |
| 3,743,336 | A | | 7/1973 | Andrews | |
| 3,782,141 | A | * | 1/1974 | Doerrfeld | 70/487 |
| 3,789,550 | A | * | 2/1974 | Seiwert | 49/503 |
| 3,919,866 | A | | 11/1975 | Lipschutz | |
| 4,116,027 | A | * | 9/1978 | Tannery | 70/472 |
| 4,231,597 | A | * | 11/1980 | Pelcin | 292/164 |
| 4,312,205 | A | * | 1/1982 | Reed et al. | 70/472 |
| 4,335,595 | A | * | 6/1982 | Swan et al. | 70/149 |
| 4,420,954 | A | * | 12/1983 | Hieronymi et al. | 70/150 |
| 4,508,377 | A | * | 4/1985 | Takasaki | 292/166 |
| 4,643,469 | A | | 2/1987 | Johnston et al. | |
| 4,704,882 | A | * | 11/1987 | Takasaki | 70/215 |
| 4,818,000 | A | | 4/1989 | Bobrowski | |
| D303,620 | S | | 9/1989 | Russell et al. | |
| D303,621 | S | | 9/1989 | Russell et al. | |
| 4,951,486 | A | * | 8/1990 | Braun et al. | 70/208 |
| 4,986,576 | A | * | 1/1991 | Anderson | 292/40 |
| 5,072,977 | A | * | 12/1991 | Millman et al. | 292/336.3 |
| 5,413,391 | A | * | 5/1995 | Clavin et al. | 292/170 |
| 5,450,737 | A | | 9/1995 | Sasaki | |
| 5,626,374 | A | | 5/1997 | Kim | |
| 5,823,583 | A | * | 10/1998 | Sandhu et al. | 292/173 |
| 5,927,773 | A | * | 7/1999 | Larsen et al. | 292/337 |
| 6,460,902 | B1 | | 10/2002 | Kyle | |
| D465,142 | S | | 11/2002 | Weinerman et al. | |
| 6,708,537 | B1 | | 3/2004 | Eschweiler et al. | |
| 6,719,332 | B2 | * | 4/2004 | Sekulovic | 292/170 |
| 6,722,716 | B2 | * | 4/2004 | Baser | 292/336.3 |
| 6,854,304 | B2 | * | 2/2005 | Linares | 70/208 |
| 6,877,752 | B2 | * | 4/2005 | Edwards | 280/37 |
| 6,877,782 | B2 | * | 4/2005 | Magnusson | 292/170 |
| 7,004,518 | B2 | * | 2/2006 | Baser | 292/336.3 |
| 7,080,531 | B2 | | 7/2006 | Vitry et al. | |
| 7,083,205 | B2 | * | 8/2006 | Hall | 292/34 |
| 7,111,879 | B2 | | 9/2006 | Zweibohmer et al. | |
| 7,175,144 | B2 | | 2/2007 | Yen et al. | |
| 7,182,374 | B2 | * | 2/2007 | Figge et al. | 292/334 |
| 7,267,379 | B2 | * | 9/2007 | Rusiana | 292/332 |
| 7,399,009 | B2 | * | 7/2008 | Hall et al. | 292/100 |
| 7,410,194 | B2 | | 8/2008 | Chen et al. | |
| 7,588,211 | B2 | | 9/2009 | Granzeier et al. | |
| 7,603,880 | B2 | | 10/2009 | Chen | |
| 7,798,540 | B1 | * | 9/2010 | Vitry et al. | 292/216 |
| 2008/0190150 | A1 | | 8/2008 | Hoffmann | |
| 2010/0244465 | A1 | * | 9/2010 | Loret de Mola | 292/164 |
| 2012/0080890 | A1 | * | 4/2012 | Loret de Mola | 292/157 |

* cited by examiner

TWO ASSEMBLY PARTS LATCH SYSTEM

This application is a divisional of pending application Ser. No. 12/384,064 filed Mar. 31, 2009, the disclosures of which are incorporated herein by reference.

BACKGROUND OF THE INVENTION

Bolt latches are commonly used to secure doors, bins, overhead lockers, etc., particularly in the interior of aircraft and marine vessels to allow opening for access and closing to lock or secure.

For decades the aerospace and marine industries has offered latches of similar appearance and operation leaving the users in the industry with few choices and a lack of variety in esthetic appearance from which to choose latches for aircraft, yachts or the like.

One reason there is very little variety in the appearance and styles of latches is the cost of manufacture and tooling. Casting is the way to make latches affordable and to cover the complexity of a latch which is manufactured as a unitary assembly. An example of such a unitary assembly is described in Andrews U.S. Pat. No. 1,995,338. However, manufacturing costs for a unitary latch assembly are very costly due to the complexity of the parts. The unitary latch assembly requires a more expensive mold for casting and is complex to manufacture by machining.

SUMMARY OF THE INVENTION

Briefly, the present invention comprises a two assembly part latch system comprising the "actuator housing assembly" and the "bolt mechanism assembly", which provides the application of several actuating functions for the actuator housing assembly while maintaining the same bolt mechanism assembly for latching. The "actuator housing assembly" is the visible portion of the latch that is used to actuate the bolt mechanism assembly. The latch forming part of the bolt mechanism assembly can be activated by means of a paddle acting as a lever over a pivoting axis, a push button acting in a linear action, or a rocker push button, acting in arc motion by means of pushing over a pivot axis.

It is a major feature of this invention that the two assemblies can be attached and detached from each other. In this way the one assembly can be changed, leaving the other in place. This permits, for example, the switching out of the actuator housing assembly to provide different activation means, viz., paddle, push button, rocker, as desired. This is significant since normally the activation means is visible within an aircraft or marine vessel and provides aesthetic effects as well as function. Thus, this invention makes it easier to accommodate a desired aesthetic choice of color or artwork.

In one aspect, the invention comprises a bolt mechanism assembly comprising:

means for mounting on a complementary surface of a panel, a bolt mechanism assembly housing carried by said means for mounting, a sliding bolt assembly carried by said bolt mechanism assembly housing including a bolt, one end of which has means adapted to engage and latch to a striker, a spring in said housing for keeping said end of the bolt extending out of the bolt mechanism assembly housing to latch to the striker, said bolt mechanism assembly housing including access means for a hammer adapted to compress said spring and withdraw said end of said bolt from latching to said striker, said backing plate having means adapted to enable attachment to and detachment from an actuator housing assembly having complementary means adapted to enable attachment and detachment.

The invention further comprises a bolt mechanism assembly comprising:

a backing plate adapted to be mounted on a complementary surface of a panel, a bolt mechanism assembly housing attached to said backing plate, a sliding bolt assembly carried by said bolt mechanism assembly housing including a bolt one end of which has means adapted to engage and latch to a striker, said bolt having a laterally extending projection, a spring in said housing for keeping said end of the bolt extending out of the bolt mechanism assembly housing to latch to the striker said bolt mechanism assembly housing including access means for a hammer adapted to compress said spring and withdraw said end of said bolt from latching to said striker said means for mounting adapted to enable attachment to and detachment from an actuator housing assembly having complementary means adapted to enable attachment and detachment.

In another aspect, the invention comprises an actuator housing assembly comprising:

an actuator housing having an opening therein, a movable actuator member, received in said opening, said actuator member having a front surface and a rear surface and being digitally movable in said opening, a hammer extending from said rear surface of said movable actuator member said actuator housing assembly having means adapted to enable the attachment to and detachment from a bolt mechanism assembly having complementary means adapted to enable attachment and detachment.

In still another aspect, the invention comprises an easily modified closure latching system comprising the combination of a bolt mechanism assembly and an actuator housing assembly, said bolt mechanism assembly comprising a backing plate adapted to be mounted on a complementary surface of a panel, a bolt mechanism assembly housing attached to said backing plate, a sliding bolt assembly carried by said bolt mechanism assembly housing, said sliding bolt assembly including a bolt one end of which has means adapted to engage and latch to a striker, a spring in said housing for keeping said end of the bolt extending out of the housing to latch to the striker, said bolt mechanism assembly housing including access means for a hammer adapted to compress said spring and withdraw said end of the bolt from latching to said striker; and attachably and detachably connected to said bolt mechanism assembly in operative relationship, said actuator housing assembly comprising an actuator housing having an opening therein, a movable actuator member received in said opening, said actuator member having a front surface and a rear surface and being digitally movable in said opening, a hammer extending from said rear surface of said movable actuator member and adapted to move in said opening and to compress said spring upon movement of said actuator member and withdraw said bolt from latching to said striker.

In one embodiment, the invention comprises an easily modified closure latching system comprising the combination of a bolt mechanism assembly and an actuator housing assembly, said bolt mechanism assembly comprising a backing plate adapted to be mounted on a complementary surface of a panel a pair of bolt mechanism assembly housings attached to said backing plate, a pair of side-by-side sliding bolt assemblies carried by said bolt assembly housing, each said sliding bolt assemblies including a bolt one end of each of which has means adapted to engage and latch to a striker, springs in said housing for keeping end of each the bolts extending out of the housing to latch to a striker, each said bolt mechanism assembly housing including access means for a hammer adapted to compress said spring and withdraw said end of the bolt from latching to said striker; and attachably and detachably connected to said bolt mechanism assembly in operative relationship, said actuator housing assembly comprising an actuator housing having a pair of openings therein, movable actuators member received in each said openings, each said actuator member having a front surface and a rear surface and being digitally movable in said opening, a hammer extending at an essentially right angle from said rear surface of each of said movable actuator members and adapted to move in said opening and to compress said spring upon movement of said actuator members and withdraw said bolts from latching to said strikers.

In one preferred embodiment, the invention comprises an easily modified closure latching system comprising the combination of a bolt mechanism assembly and an actuator housing assembly, said bolt mechanism assembly comprising a backing plate adapted to be mounted on a complementary surface of a panel a bolt mechanism assembly housing attached to said backing plate, a sliding bolt assembly carried by said bolt mechanism assembly housing said sliding bolt assembly including a bolt one end of which has means adapted to engage and latch to a striker, said bolt having a laterally extending projection, a spring in said housing for keeping said end of the bolt out of the housing to latch to the striker said bolt mechanism assembly housing including passage access for a hammer adapted to compress said spring and withdraw said end of the bolt from latching to said striker; and attachably and detachably connected to said bolt mechanism assembly in cooperative relationship, said actuator housing assembly comprising an actuator housing having an opening therein, a movable push button actuator member received in said opening, said actuator member having a front surface and a rear surface and being digitally movable in said opening, a hammer extending at an essentially right angle from said rear surface of said movable push button actuator member and adapted to move in said opening and to compress said spring by contact with said laterally extending projection upon inward movement of said push button actuator member and withdraw said bolt from latching to said striker.

In another embodiment, the invention comprises an easily modified closure latching system comprising the combination of a bolt mechanism assembly and an actuator housing assembly, said bolt mechanism assembly comprising a backing plate adapted to be mounted on a complementary surface of a panel a bolt mechanism assembly housing attached to said backing plate, a sliding bolt assembly carried by said bolt mechanism assembly housing, said sliding bolt assembly including a bolt one end of which has means adapted to engage and latch to a striker, said bolt having a laterally extending projection, a spring in said housing for keeping said end of the bolt out of the housing to latch to the striker said bolt mechanism assembly housing including access means for a hammer adapted to compress said spring and withdraw said end of the bolt from latching to said striker; and attachably and detachably connected to said bolt mechanism assembly in operative relationship, said actuator housing assembly comprising an actuator housing having an opening therein, a movable rocker actuator member pivotally received in said opening and pivotally attached to said actuator housing, said actuator member having a front surface and a rear surface and being digitally movable in said opening, a hammer extending at an essentially right angle from said rear surface of said movable rocker actuator member and adapted to move in said opening and to compress said spring by contact with said laterally extending projection upon pivotal inward movement of said rocker actuator member and withdraw said bolt from latching to said striker.

In still another embodiment, the invention comprises an easily modified closure latching system comprising the combination of a bolt mechanism assembly and an actuator housing assembly, said bolt mechanism assembly comprising a backing plate adapted to be mounted on a complementary surface of a panel a bolt mechanism assembly housing attached to said backing plate, a sliding bolt assembly carried by said bolt mechanism assembly housing, said sliding bolt assembly including a bolt one end of which has means adapted to engage and latch to a striker;

a spring in said housing for keeping said end of the bolt out of the housing to latch to the striker said bolt mechanism assembly housing including access means for a hammer adapted to compress said spring and withdraw said end of the bolt from latching to said striker; and attachably and detachably connected to said bolt mechanism assembly in operative relationship, said actuator housing assembly comprising an actuator housing having an opening therein, a movable paddle actuator member pivotally received in said opening, said actuator member having a front surface and a rear surface and being digitally movable in said opening, a hammer extending at an essentially right angle from said rear surface of said movable paddle actuator member and adapted to move in said opening and to compress said spring upon pivotal movement of said paddle actuator member outwardly from said actuator housing and withdraw said bolt from latching to said striker.

In another preferred embodiment, the invention comprises an easily modified three point closure latching system for engagement with three spaced apart strikers comprising the combination of a bolt mechanism assembly and an actuator housing assembly, said bolt mechanism assembly comprising a backing plate adapted to be mounted on a complementary surface of a panel a bolt mechanism assembly housing attached to said backing plate, a sliding bolt assembly carried by said bolt mechanism assembly housing, said sliding bolt assembly including a bolt one end of which has means adapted to engage and latch to a striker, a spring in said housing for keeping said end of the bolt out of the housing to latch to the striker said bolt assembly housing including access means for a hammer adapted to compress said spring and withdraw said end of the bolt from latching to said striker attachably and detachably connected to said bolt mechanism assembly in operative relationship, said actuator housing assembly comprising an actuator housing having an opening therein, a movable actuator member received in said opening, said actuator member having a front surface and a rear surface and being digitally movable in said opening, a hammer extending at an essentially right angle from said rear surface of said movable actuator member and adapted to move in said opening and to compress said spring upon movement of said actuator member and withdraw said bolt from latching to said striker, lateral openings in a said bolt assembly housing, two laterally spaced apart latch means; and linkage means through said lateral openings connecting said bolt to each of said spaced apart latch means, whereby when said spring is compressed, said bolt withdraws the end thereof from latching to said striker and simultaneously unlatches said two laterally spaced apart latch means.

There are two main component assemblies forming the closure latching system of this invention, the bolt mechanism assembly (mechanism) and the actuator housing assembly. The actuator housing assembly includes a pivoting lever paddle or a pivoting elongated rocker button, or a push button. This assembly of the latch can be designed to take many forms and styles to accommodate different esthetic designs. The actuator housing assembly has a housing, carrying the paddle, rocker or push button, all equipped with a hammer projecting from the rear surface that is adapted to interface with the mechanism to pull down the latching bolt. In cases where the paddle or rocker lever applications are used, a pivot pin is used to activate the bolt with the hammer. The latch paddle when pulled over center of the pivot pin forces the bolt to move down, thus opening the latch assembly. In case the latch is a push button type, the hammer connected to the button has a hammer bevel or ramp which engages the bolt to move it down when the button is pushed.

The actuator housing assembly preferably is equipped with two threaded helicoils on the back side of the actuator housing assembly to secure to the closure latching system upon installation of the system to the door or drawer panel. The mechanism is designed to be similar in every instance of use (except for derivatives that require length adjustment to accommodate the users requirements). The mechanism is comprised of an extruded aluminum housing that serves a guide for the sliding of a steel (nylon in some marine/other applications) bolt up and down, a spring is used to return the bolt to the up position and is retained in place by the use of the retaining pin. The bolt is designed with a cavity or access opening to accommodate the action of the hammer that is part of the push button or rocker. The bolt mechanism assembly extrusion has a flange having two counter sunk holes therein which are used to screw the bolt mechanism assembly to the latch actuating housing during installation to the cabinet door or panel.

The closure latching system can be machined and/or cast to make latches affordable. Casting or machining is more affordable than the conventional one piece latch which requires complex casting techniques.

THE DRAWINGS

DESCRIPTION OF THE PREFERRED EMBODIMENTS

Parts List

Figure 1A:
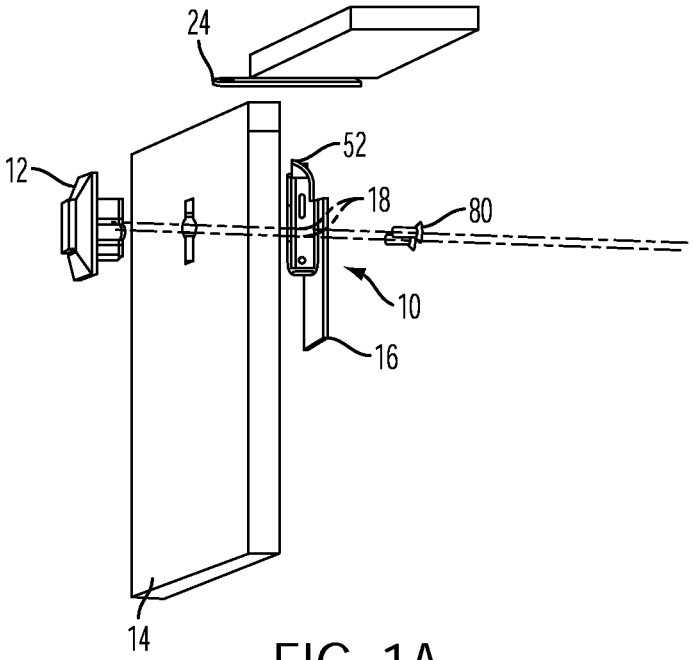
FIG. 1A is an exploded perspective view of the push button actuated embodiment of the latch of this invention showing how the device is mounted on a panel and the bolt engage striker.
Figure 1B:
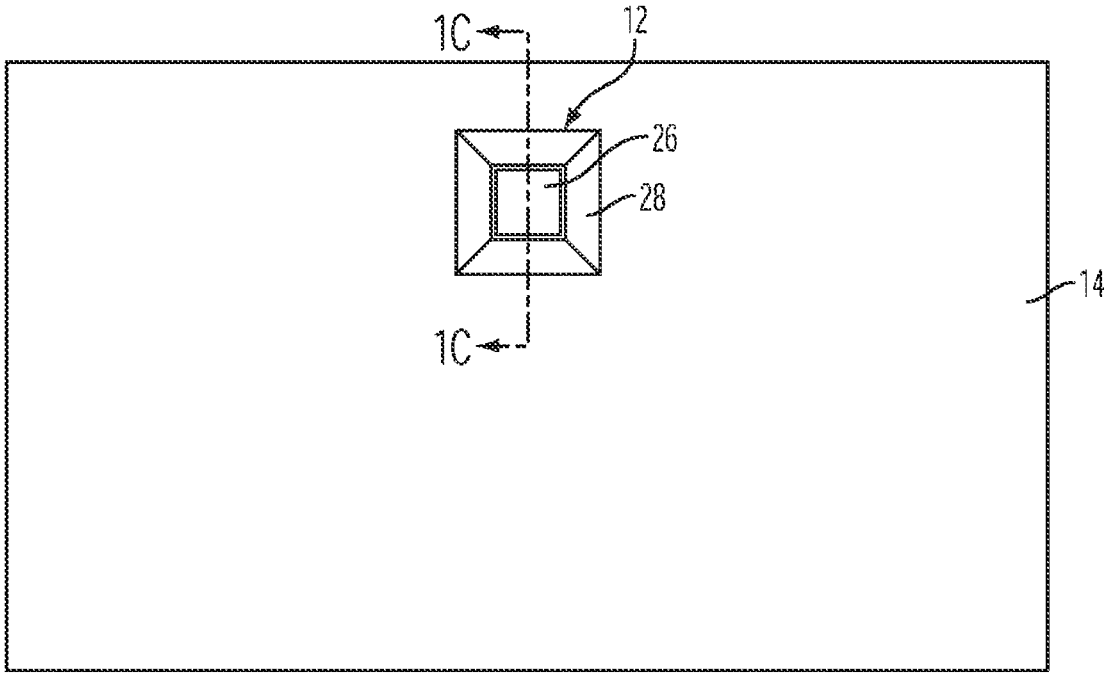
FIG. 1B is a front plan view showing the push button actuated embodiment mounted on a panel.

| | |
|---|---|
| bolt mechanism assembly | 10 |
| actuator housing assembly | 12 |
| panel | 14 |
| bolt mechanism backing plate | 16 |
| bolt housing | 18 |
| bolt | 20 |
| bolt end | 22 |
| striker | 24 |
| push button actuator | 26 |
| push button actuator housing | 28 |
| hammer | 30 |
| ramp on hammer | 32 |
| hammer access opening in bolt housing | 34 |
| bolt actuating pin | 36 |
| rotatable sleeve on bolt actuating pin | 38 |
| bolt spring | 40 |
| spring retaining pin | 42 |
| lower bolt pin | 44 |
| upper bolt pin | 46 |
| slots in bolt housing | 48 |
| fork | 50 |
| cam | 52 |
| cam pin | 54 |
| cam support surface | 56 |
| countersunk holes in backing plate | 58 |
| rocker actuator | 60 |
| rocker pivot pin | 62 |
| paddle actuator | 64 |
| paddle pin | 66 |
| spring cap | 68 |
| oval paddle actuator slot | 70 |
| oval paddle slot pin | 72 |
| oval paddle actuator linkage | 74 |
| oval paddle actuator | 76 |
| threaded openings in actuator | 78 |
| screws | 80 |
| side latches | 82 |
| side openings in bolt housing | 84 |
| linkages connecting to side latches | 86 |

Turning to the drawings in more detail, with particular reference to the push button actuated embodiment of FIGS. 1A to 1E, the bolt mechanism assembly 10 and actuator housing assembly 12 are mounted on panel 14. The bolt mechanism 10 has a backing plate 16. The bolt mechanism 10 also includes the bolt housing 18 in which is received bolt 20 with bolt end 22. The bolt 20 reciprocates within the bolt housing 18. The bolt end 22 is adapted to engage and latch to striker 24 which is carried on any standard storage locker frame, drawer frame and the like.

The push button actuator 26 is mounted in an actuator housing 28. The actuator has on its inner side a generally projecting hammer 30. The hammer 30 has a ramp 32 on its underside which serves to actuate the bolt 20, as explained below.

The bolt housing 18 has a hammer access opening 34. Upon assembly of the bolt mechanism assembly 10 and the actuator assembly 12, the hammer 30 projects through the access opening 34 to engage the bolt activating pin 36. The pin 36 is preferably fixed into the bolt 20 and carried around it, a rotatable sleeve or bushing 38.

The ramp 32 on the hammer is adapted to engage the rotatable sleeve 38 when the actuator 26 is pushed in. The rotatability of the sleeve 38 on the pin 36 provide for smooth action when opening the latch.

The bolt 20 rides on a compressible coil spring 40. The spring 40 is received within the bolt housing 18 in a fairly snug fashion. The coil spring 40 is held within the bolt housing 18 by spring retaining pin 42. The spring is normally not fastened to the pin 42, the pin serving as a stop or rest to keep the spring within the bolt housing.

The lower bolt pin 44 is carried in side openings or through a hole at the lower extremity of bolt 20. Pin 44 is adapted to engage the upper surface of bolt coil spring 40 when to bolt is activated, that is, when the bolt moves down, the pin 44 presses down on the upper surface of the bolt spring 40, causing it to compress.

Figure 1C:
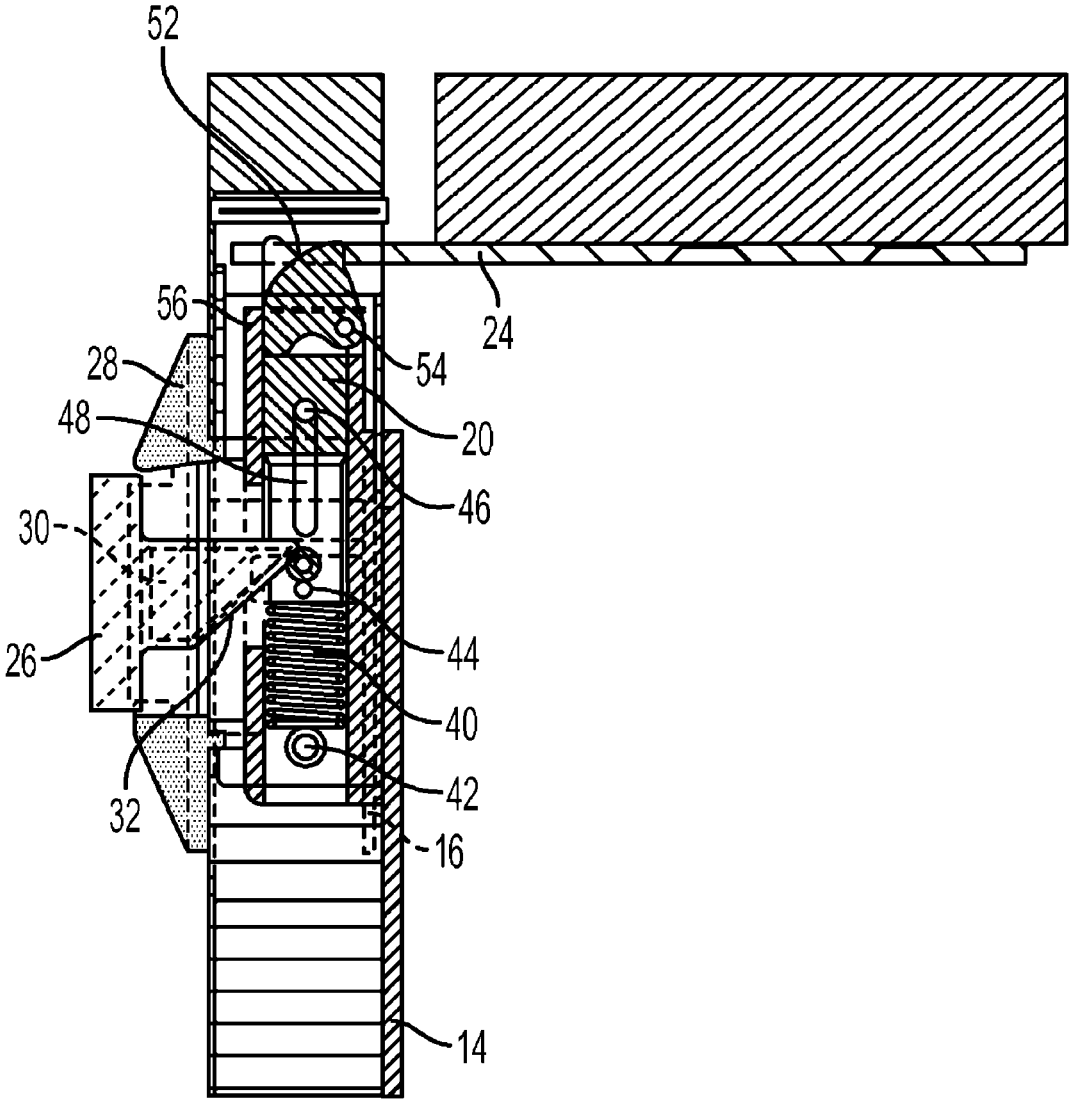
FIG. 1C is a sectional view generally taken along the line 1C-1C in FIG. 1B together with the striker, and showing the latch in the closed position.
Figure 1D:
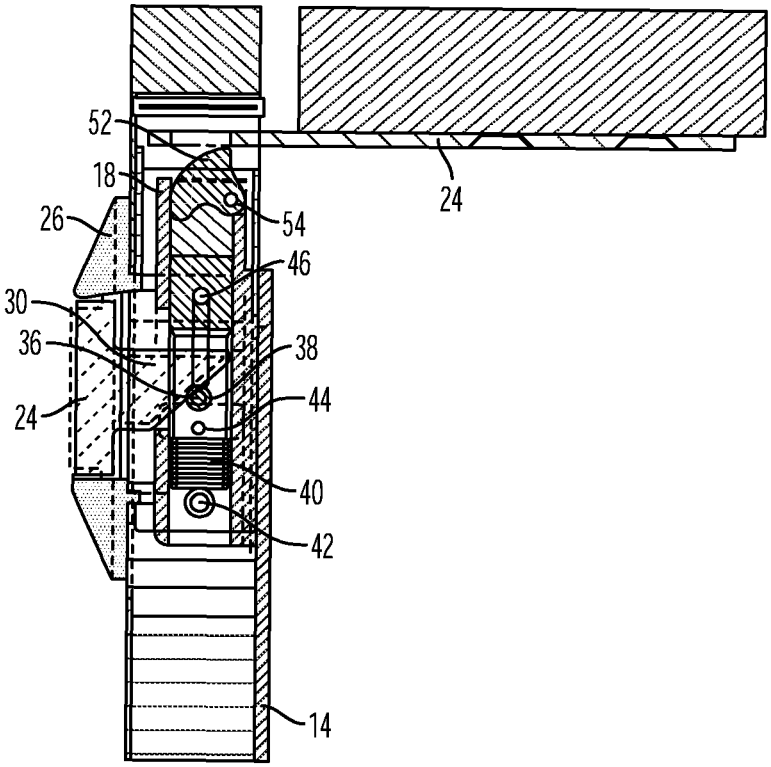
FIG. 1D is also a sectional view differing from FIG. 1C in that the latch has been opened.
Figure 1E:
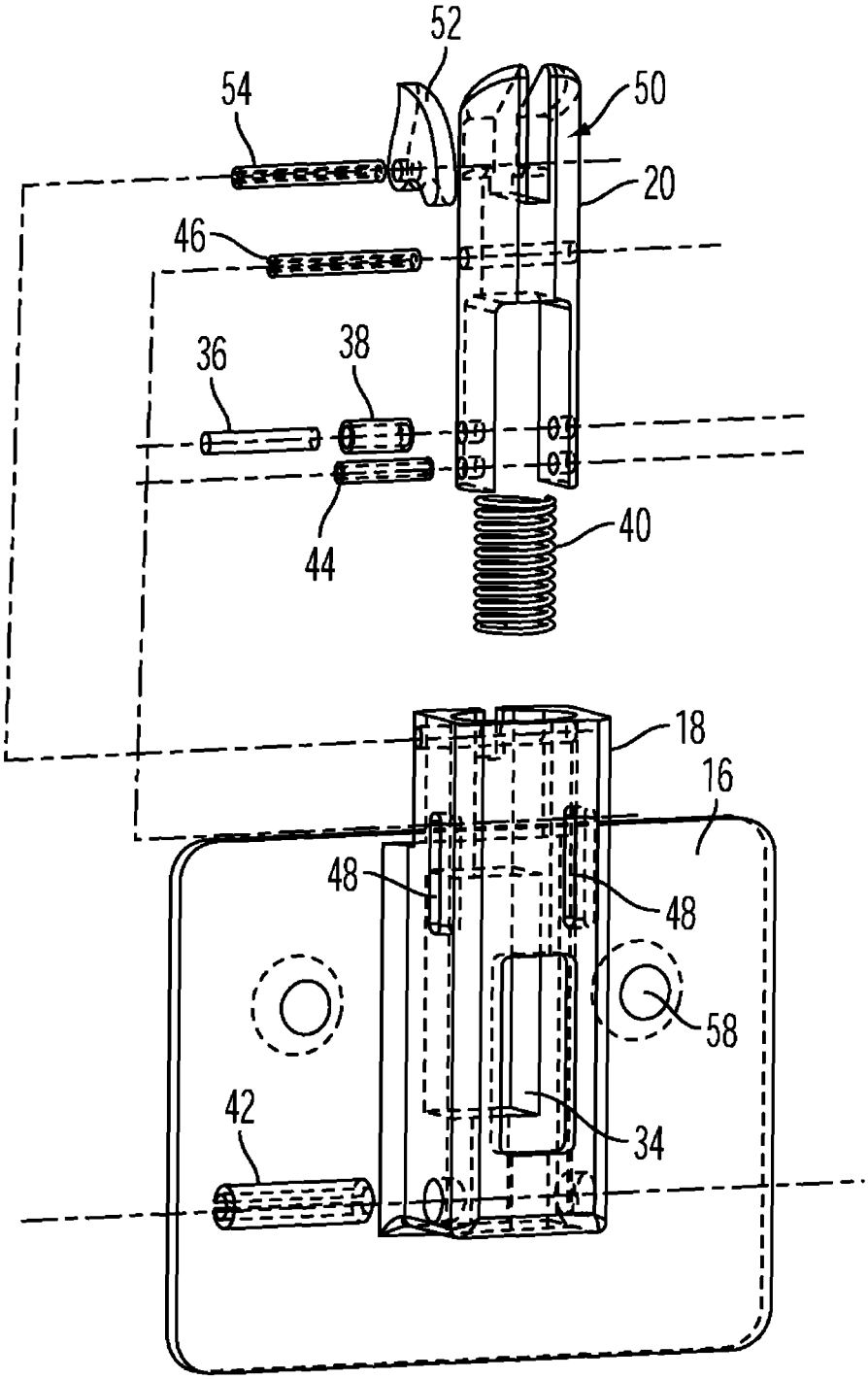
FIG. 1E is an exploded view of the bolt mechanism assembly with backing plate prior to mounting on a panel.

The upper bolt pin 46 runs laterally through bolt 20 with the ends of pin 46 being slidably received in the slots 48 in the bolt housing 18 so that the pin 46 moves up and down in the slots 48 and the bolt 20 moves up and down in the bolt housing 18. The end 22 of the bolt 20 which engages the striker 24 in one preferred embodiment has a forklike configuration 50 having a cam 52 received therein. The cam 52 is pivotally carried by cam pin 54 which is carried by the bolt housing 18. As can be seen in FIG. 1C, in the closed position, the free end of cam 52 rests on the cam surface 56 of the bolt. As the bolt moves down, this support is withdrawn and the cam 52 pivots on cam pin 54 to withdrawn the cam from engagement with striker 24, as shown in FIG. 1D.

The bolt mechanism backing plate 16 has countersunk holes therein whereby the bolt mechanism assembly 10 can be joined to the actuator housing assembly 12 and the two joined to panel 14.

In operation, upon assembly with the bolt end 22 engaging the striker 24, when the push button actuator 26 is digitally pushed in, the ramp 32 on hammer 30 engages the rotatable sleeve 38 on bolt actuating pin 36, causing the bolt 20 to move down as the ramp 32 advances on sleeve 38, compressing the bolt spring 40 which simultaneously allows the cam 52 to pivot about pin 54 and clear the striker. When the pressure on actuator is released, the bias of the spring 40 causes the various elements to return to the position shown in FIG. 1C.

Turning to 2A to 2D, here the push button actuator is replaced by rocker actuator 60 which is carried in the actuator housing by rocker pin 62 about which the rocker pivots. In this embodiment, the end 22 of the bolt 20 is solid square rod rather then being cam assisted.

Figure 2A:
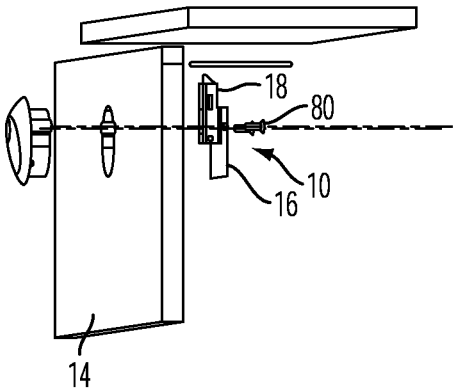
FIG. 2A is similar to FIG. 1A and shows the rocker actuated embodiment of the latch of this invention.
Figure 2B:
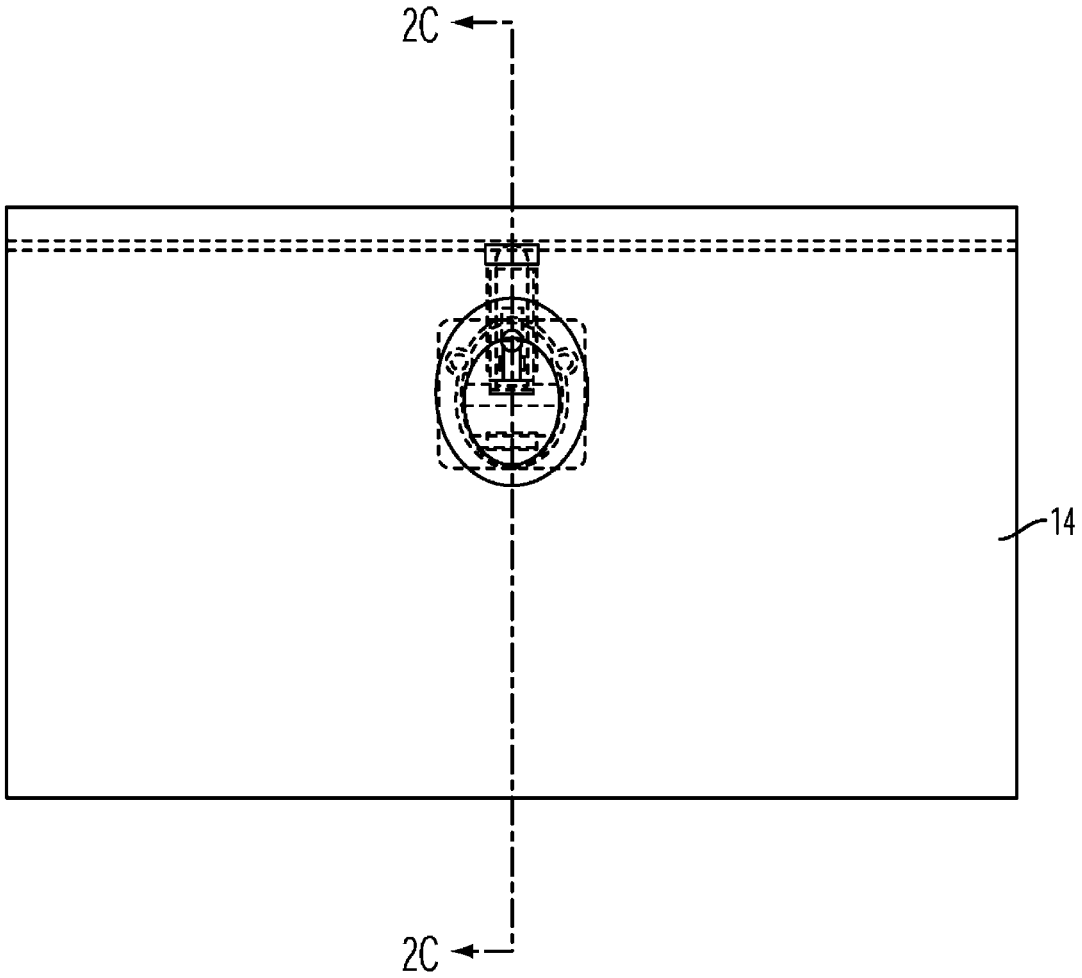
FIG. 2B is a front plan view showing the rocker actuated embodiment mounted on a panel.
Figure 2C:
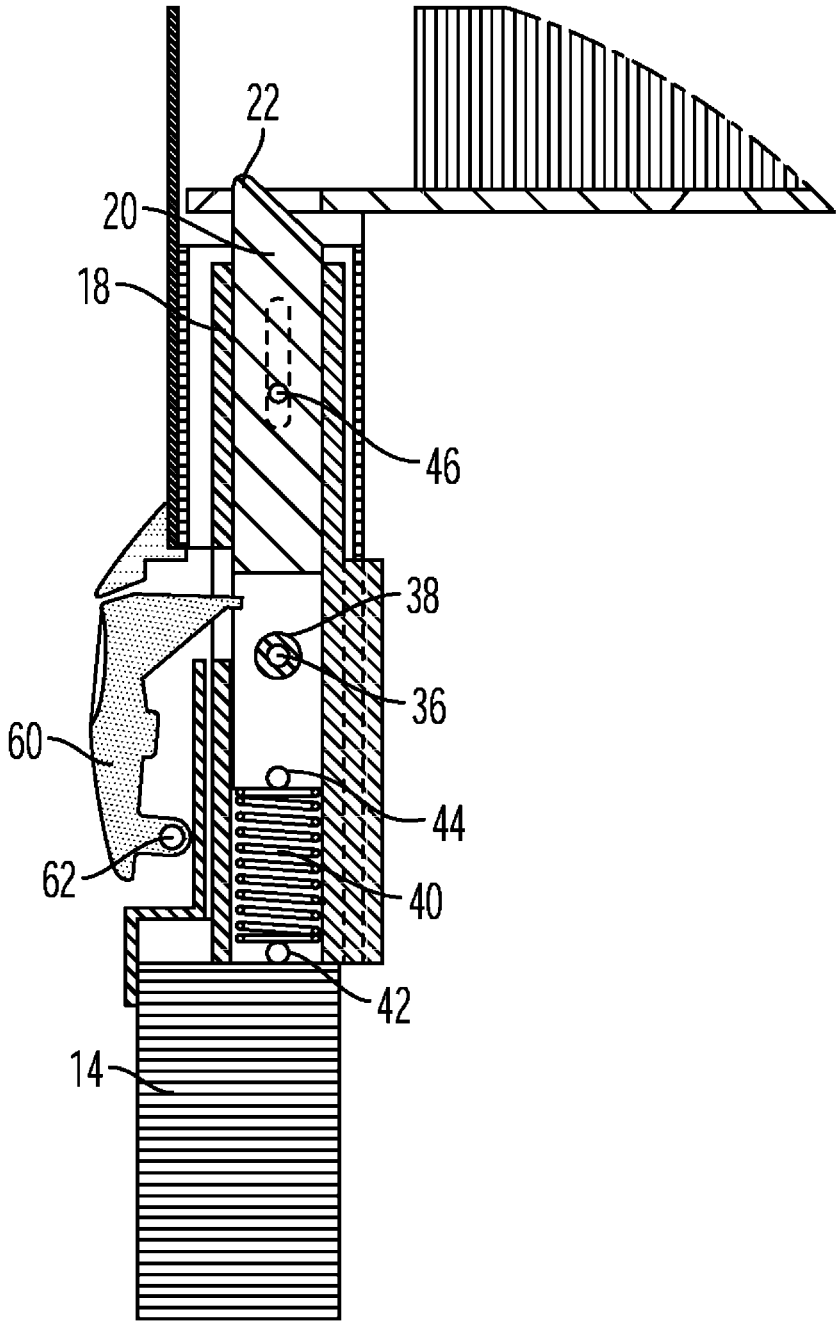
FIG. 2C is a sectional view generally taken along the line 2C-2C in FIG. 2B together with the striker and showing the latch in the closed position.
Figure 2D:
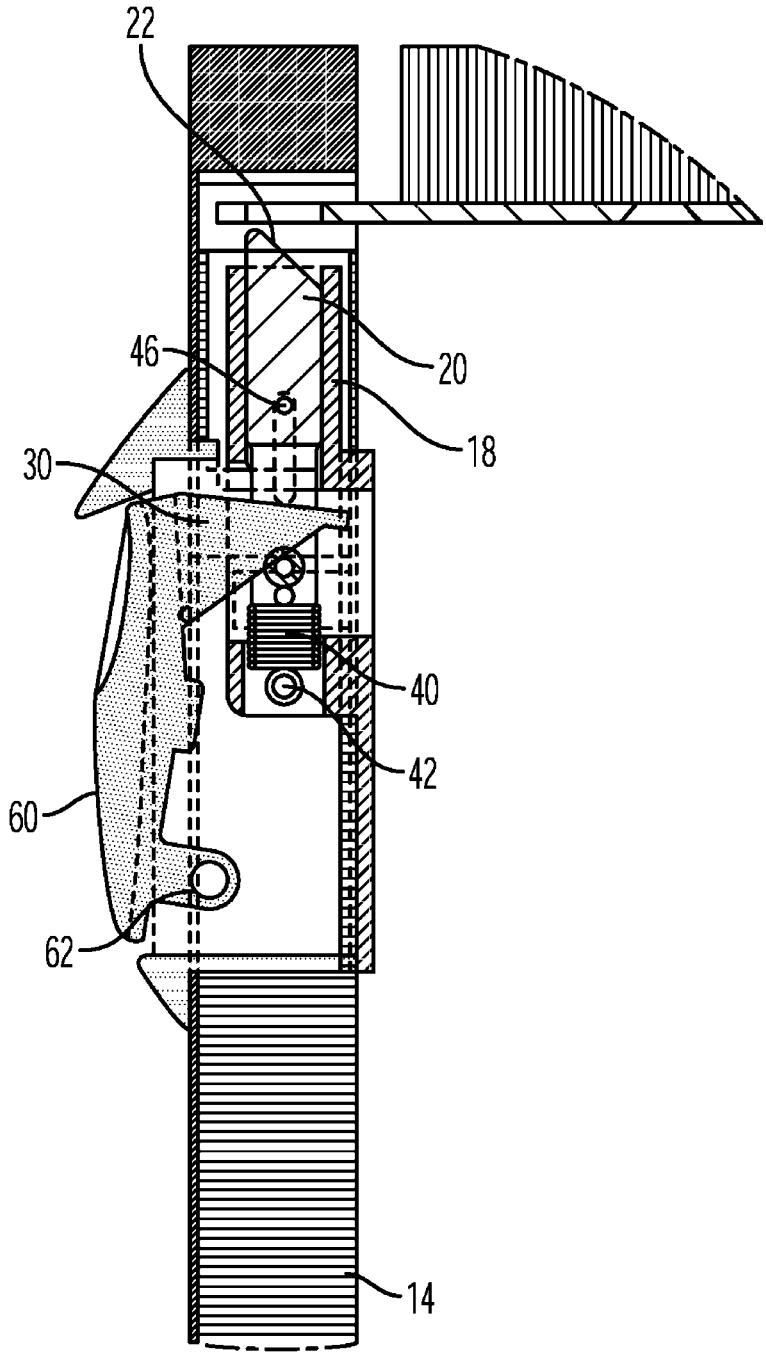
FIG. 2D is also a sectional view taken from the opposite side and differing from FIG. 2C in that the latch has been opened.
Figure 2E:
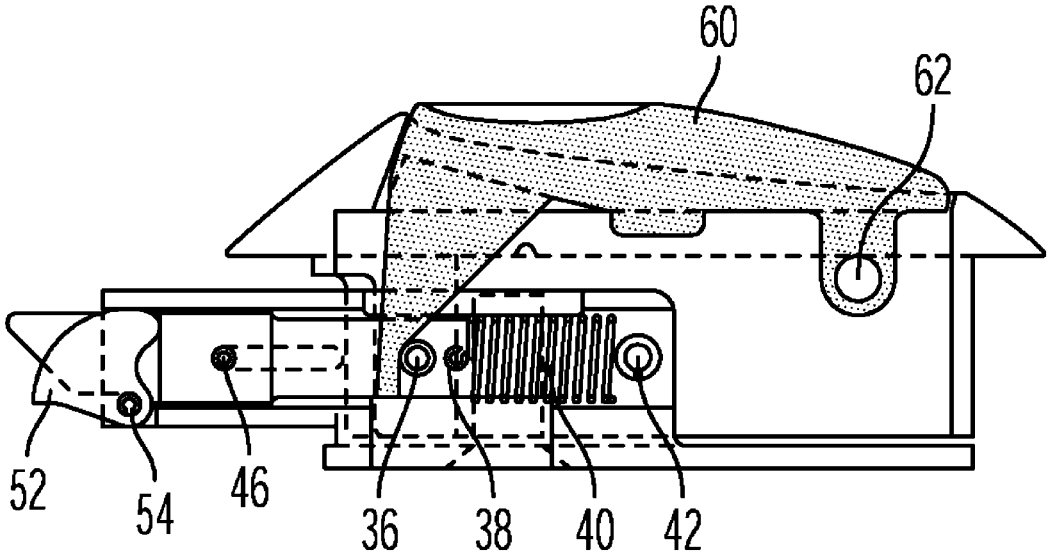
FIG. 2E is a sectional view of an alternative embodiment of the rocker actuated latch.

FIG. 2E shows the rocker actuated latch with cam assist as in FIGS. 1A to 1E.

Figure 3A:
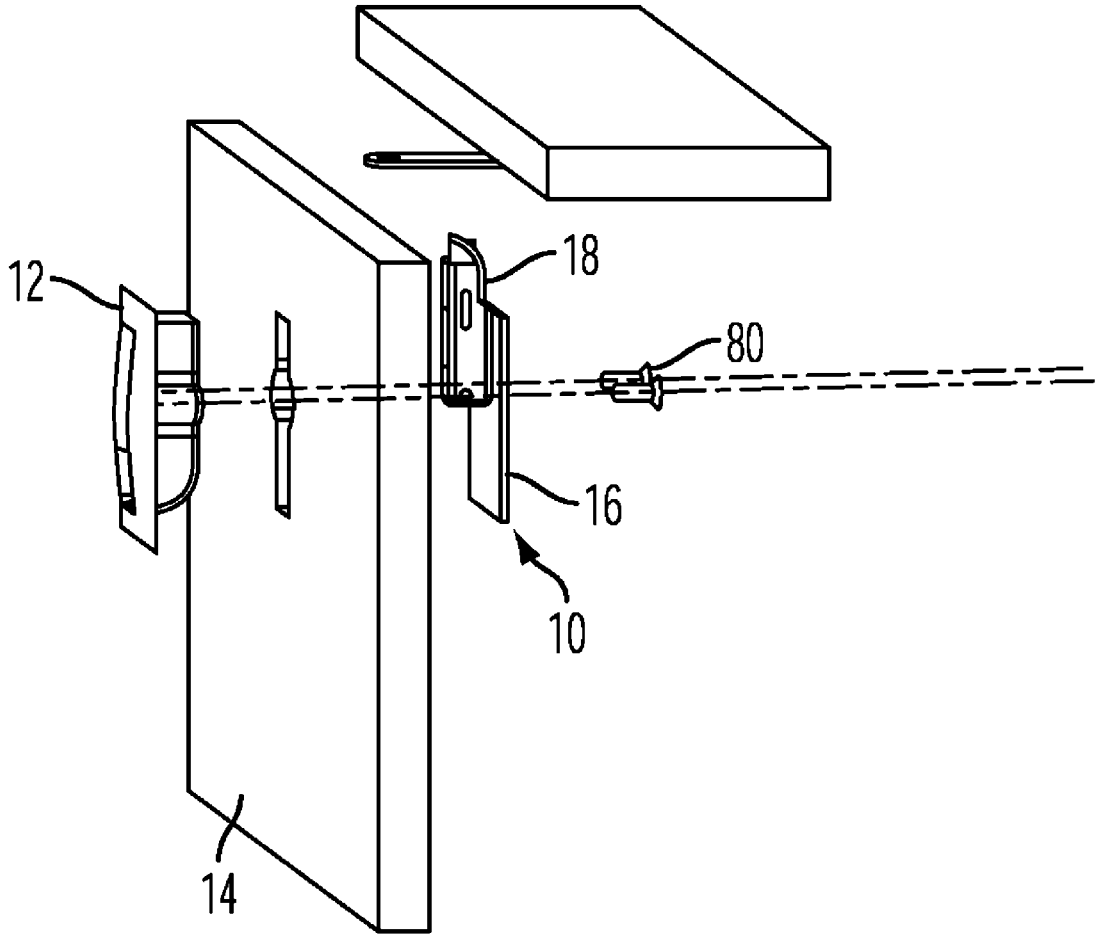
FIG. 3A is similar to FIG. 1A and shows a generally rectangular paddle actuated embodiment of this invention.
Figure 3B:
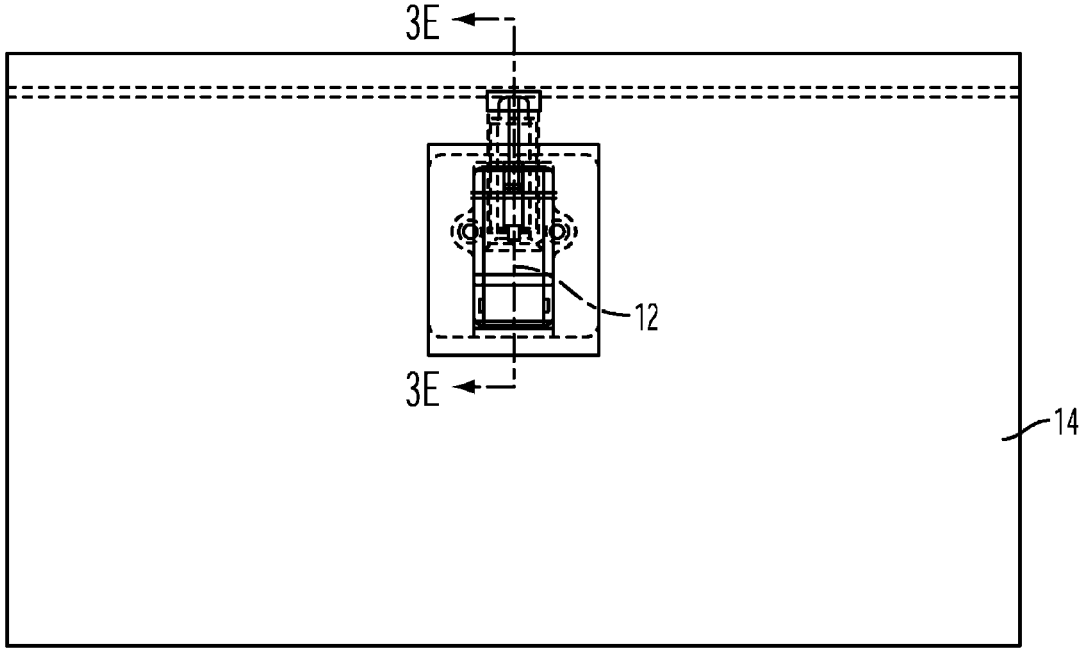
FIG. 3B is a front plan view showing the rectangular paddle actuated embodiment mounted on a panel.
Figure 3C:
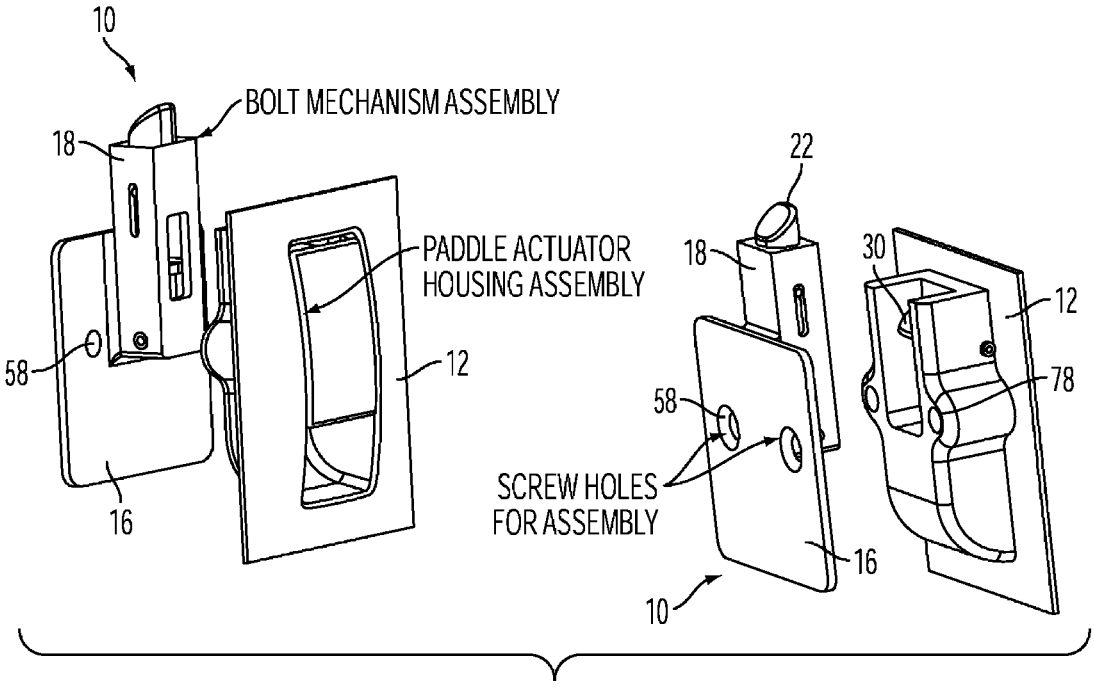
FIG. 3C shows the bolt mechanism assembly and the actuator housing assembly of the embodiment of FIGS. 3A and 3B, ready for attachment to a panel.
Figure 3D:
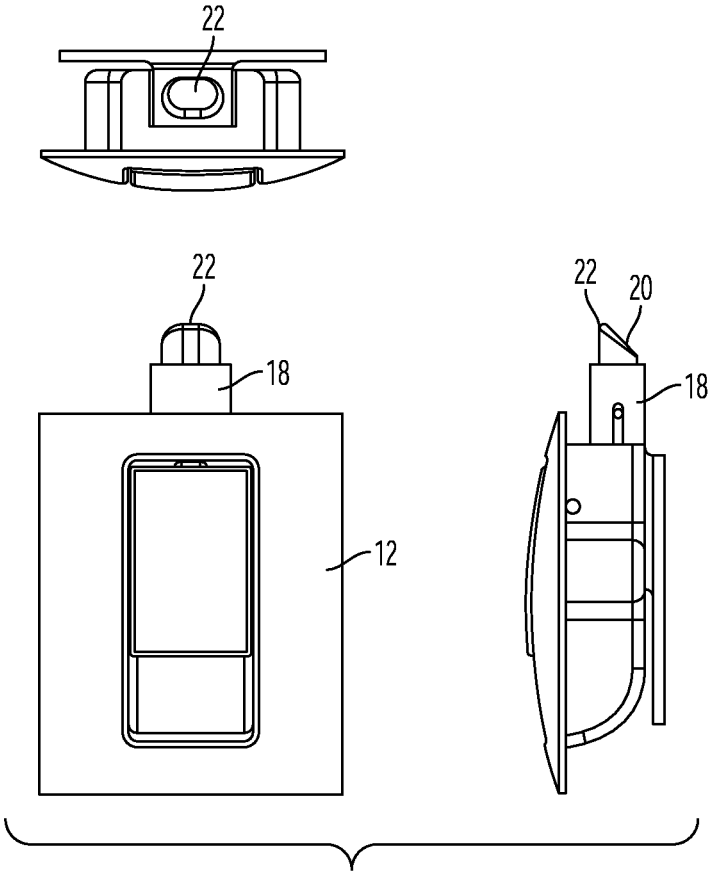
FIG. 3D shows top, front and side views of the assemblies of FIG. 3C after being screwed together.

FIGS. 3A to 3D shows the embodiment wherein the actuator is a generally rectangular paddle actuator 64 which is carried on paddle pin 66. In this embodiment, the hammer 30 does not have a ramp and the bolt does not have an activating pin. Instead, the hammer presses down on the bolt spring when the paddle is rotated about pin 66, as shown in FIG. 3F. If desired, the bolt spring may have a cap 68.

Figure 3E:
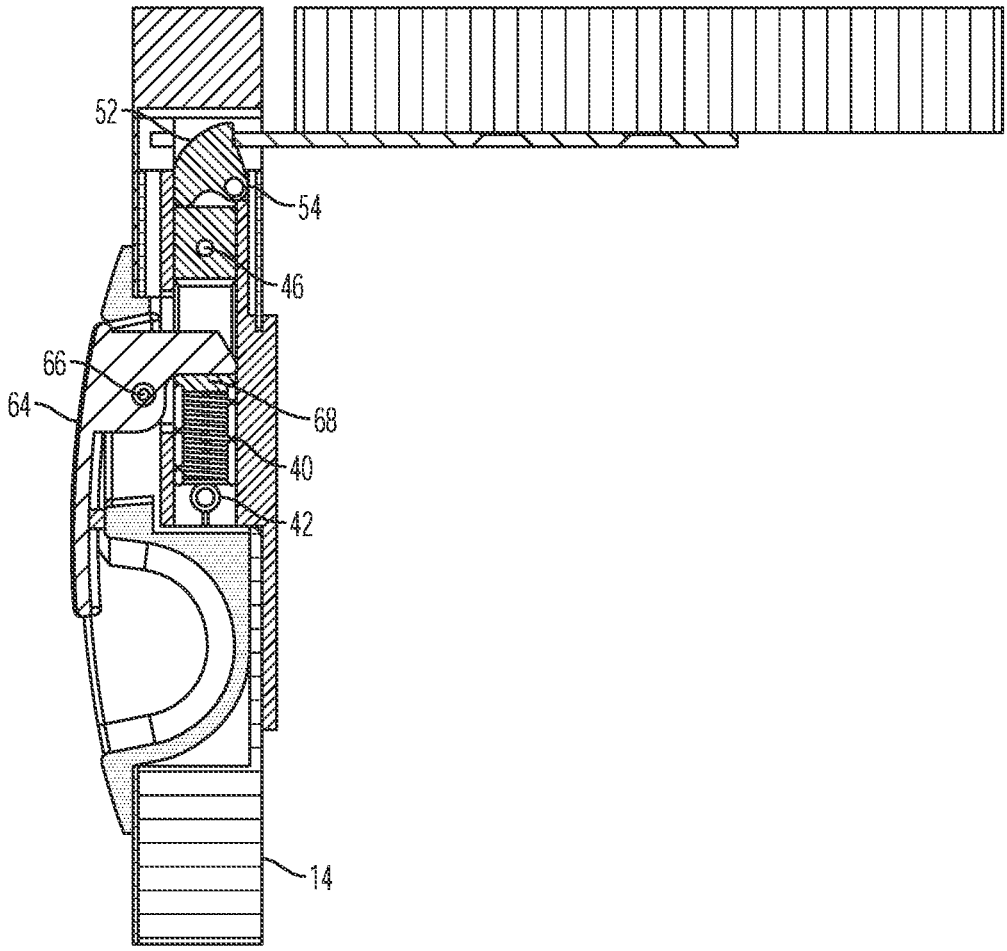
FIG. 3E is a sectional view taken along the line 3E-3E in FIG. 3B together with the striker showing the latch in the closed position, with the further proviso that the bolt is cam assembled.
Figure 3F:
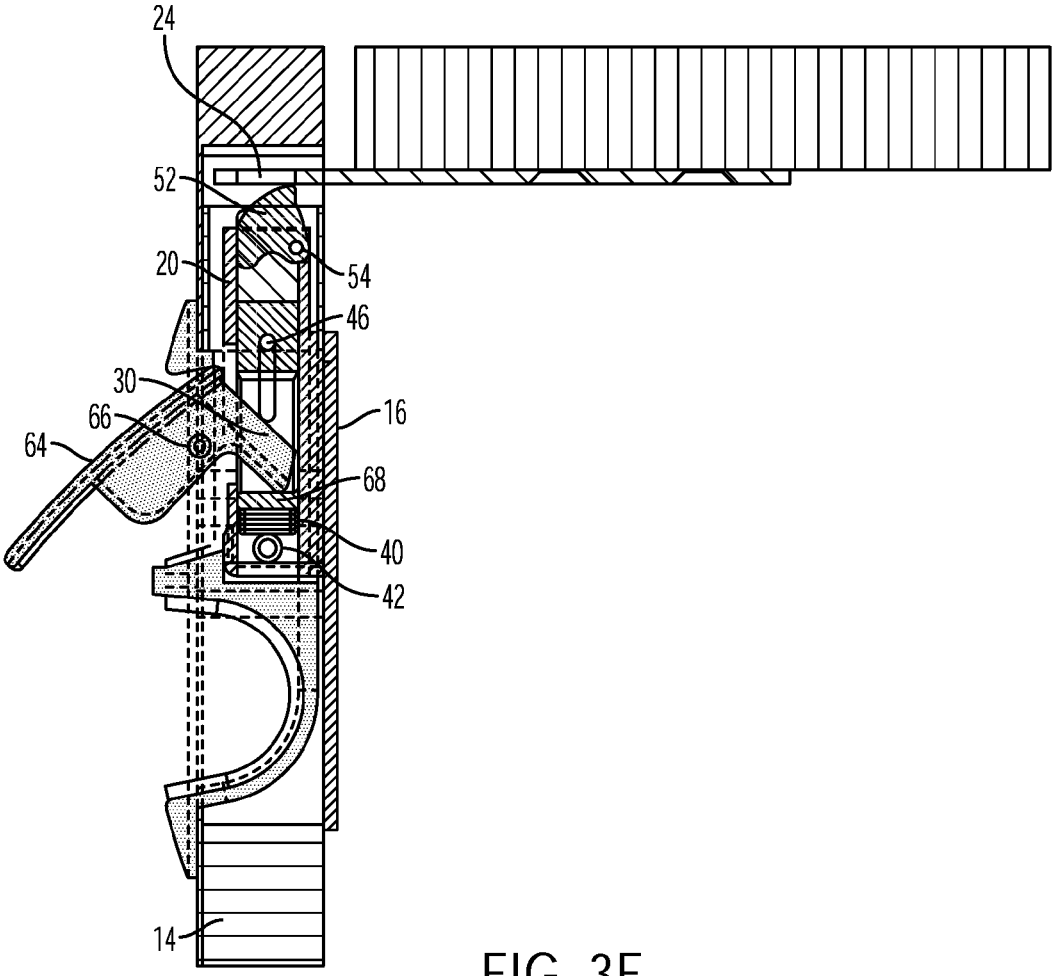
FIG. 3F is also a sectional view differing from FIG. 3E in that the latch has been opened.

In the embodiment of FIGS. 3E and 3F, there is the cam assist.

Figure 3G:
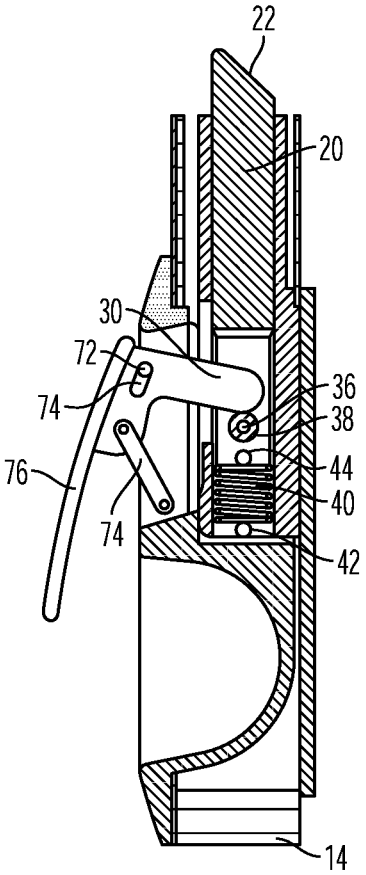
FIG. 3G is a sectional view of an alternate embodiment of the paddle actuated latch wherein the actuator is oval in shape and the bolt is solid.

In the alternate embodiment of FIG. 3G, the paddle actuator 76 is oval in shape. The oval paddle actuator 76 has a slot 70 which rides on pin 72 on the actuator housing. This allows the paddle actuator 76 together with hammer 30 to move as a whole. The oval paddle actuator 76 also has a linkage 74 connecting the underside of the oval paddle actuator 76 to the actuator housing. This arrangement affords smooth and easy operation of the oval paddle when the paddle is raised and pull out to work the bolt 20.

As can be seen in FIG. 3C, the bolt mechanism assembly 10 and the actuator housing assembly 12 are screwed together. The back of the actuator housing assembly 12 has internally threads openings 78. Screws 80 are inserted in countersunk holes 58 in the backing 16 and into openings 78 to provide complementary means to enable attachment and detachment.

Figure 4A:
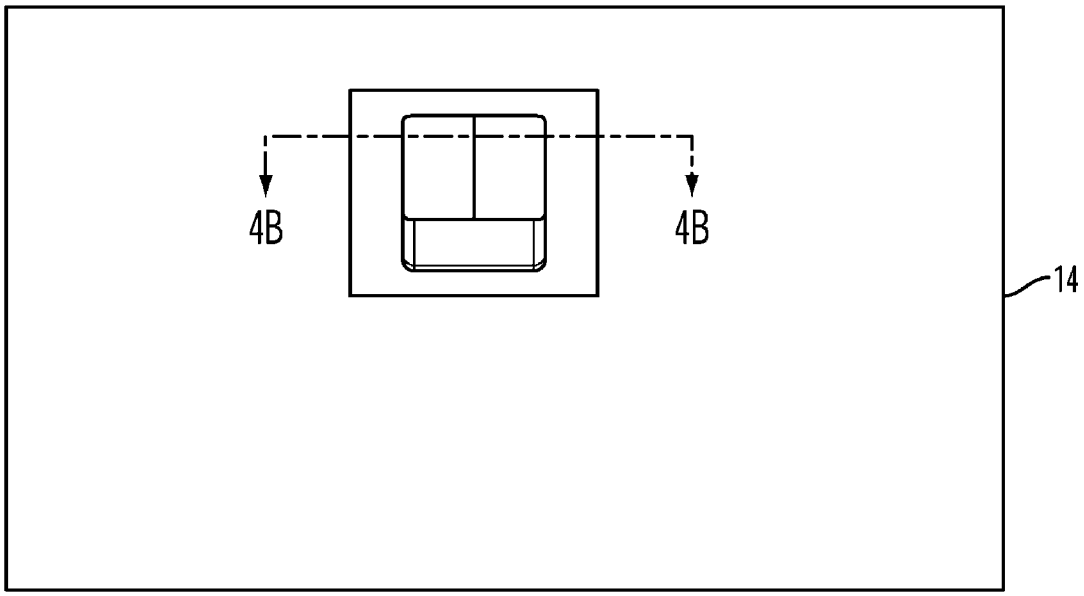
FIG. 4A is a front view of yet another embodiment of this invention having two bolts and two actuators or paddles, and otherwise similar to the embodiment of FIGS. 3A to 3F, showing the closure latching system as disposed on a door panel.
Figure 4B:
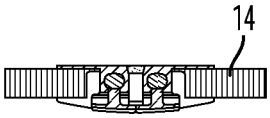
FIG. 4B is a sectional view taken along the line 4B-4B in FIG. 4A.
Figure 4C:
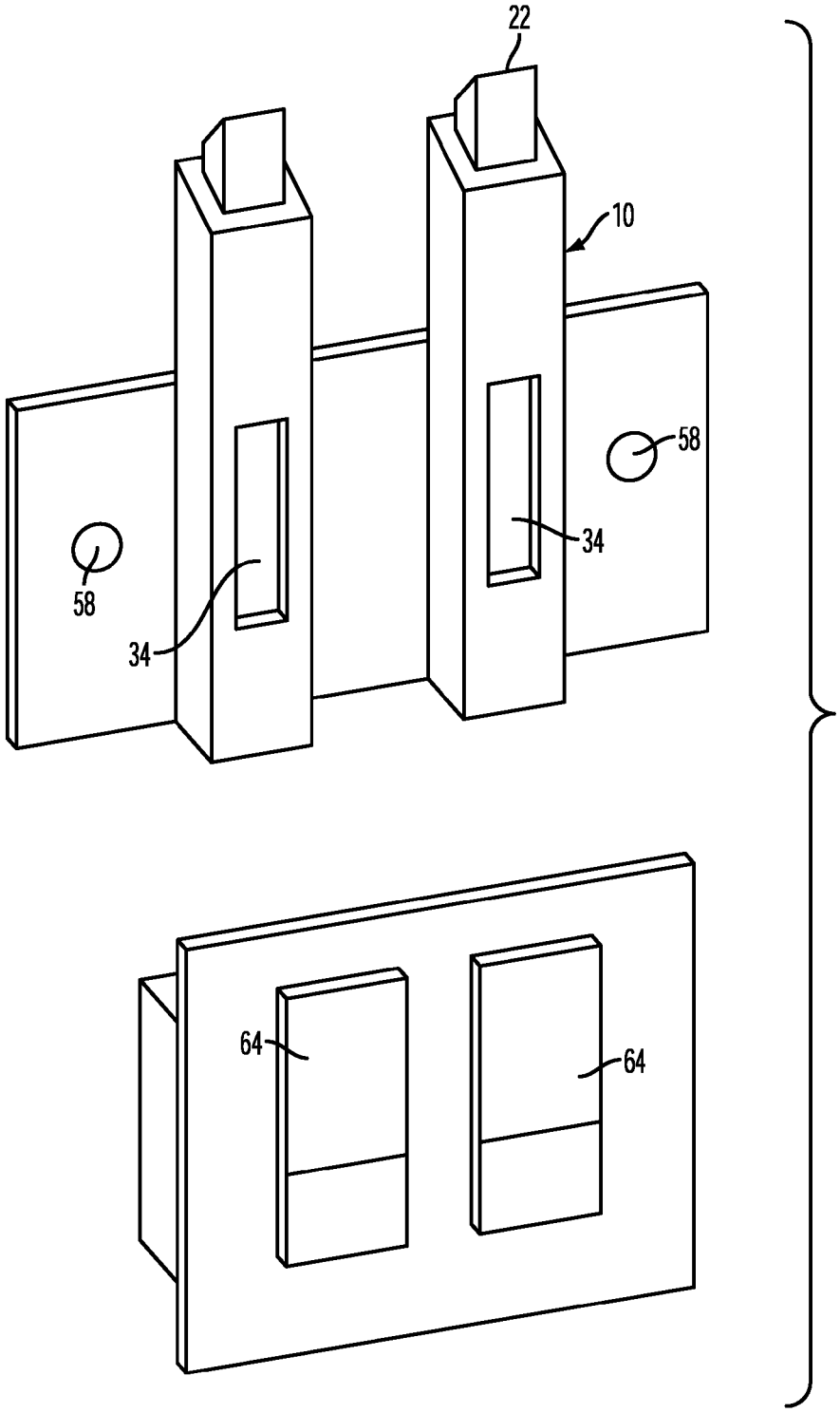
FIG. 4C shows the embodiment of FIGS. 4A and 4B in perspective views.
Figure 5A:
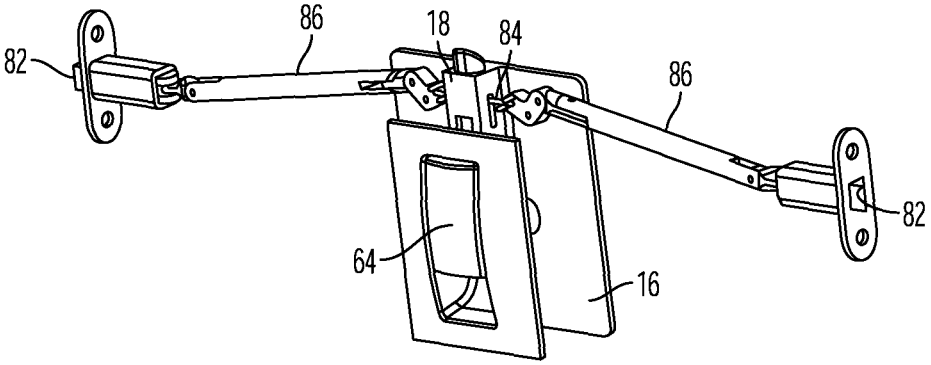
FIG. 5A is a perspective view showing one embodiment of the closure latching system of this invention connected to two additional spaced-apart latches, each with a striker, and adapted when installed to provide three point latching actuated by a single actuator.
Figure 5B:
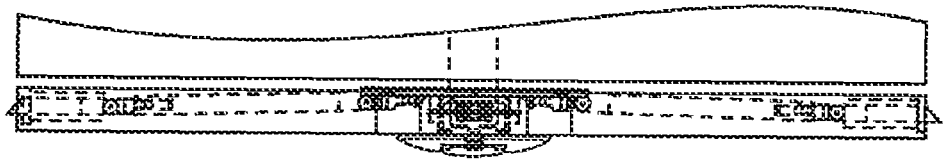
FIG. 5B is a top view of the parts shown in FIG. 5A as installed on a flat panel.
Figure 5C:
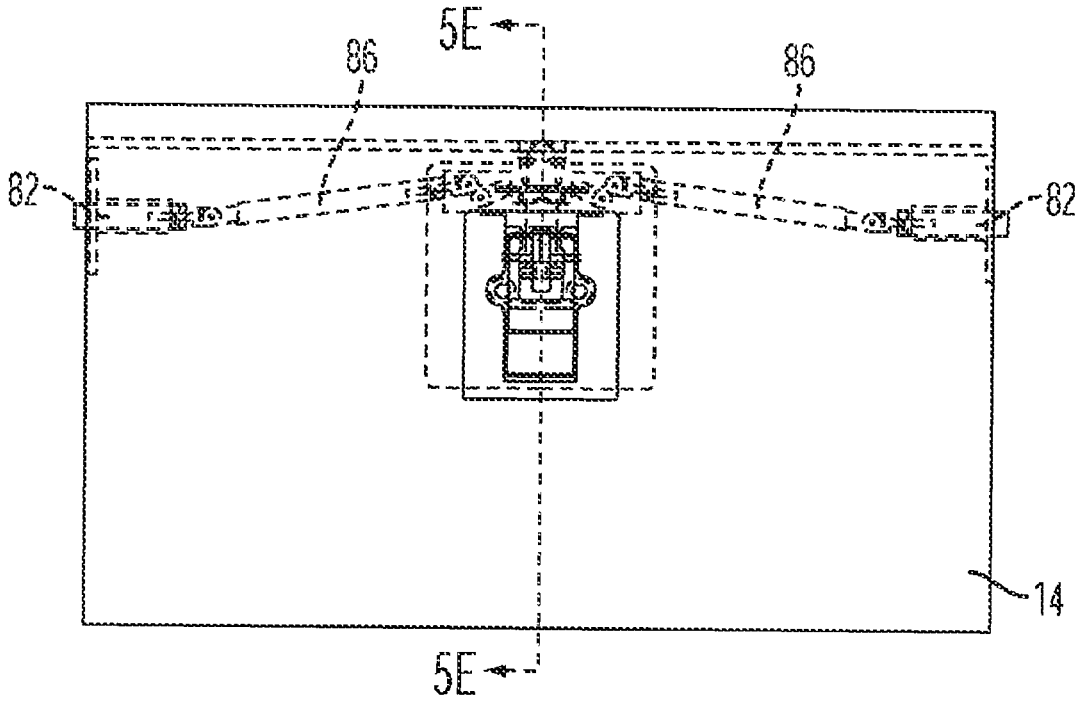
FIG. 5C is a rear plan view of the of the installation shown in FIG. 5B.
Figure 5D:
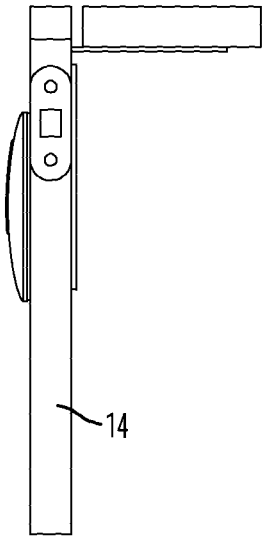
FIG. 5D is a side plan view of the structure shown in FIG. 5C.
Figure 5E:
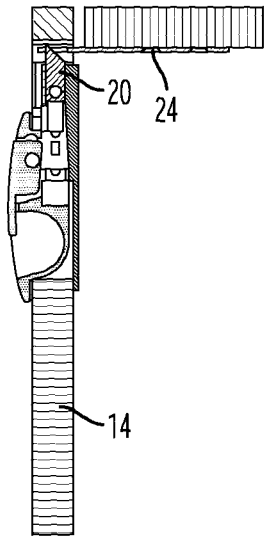
FIG. 5E is a sectional view taken along the line 5E-5E in FIG. 5C.
Figure 6:
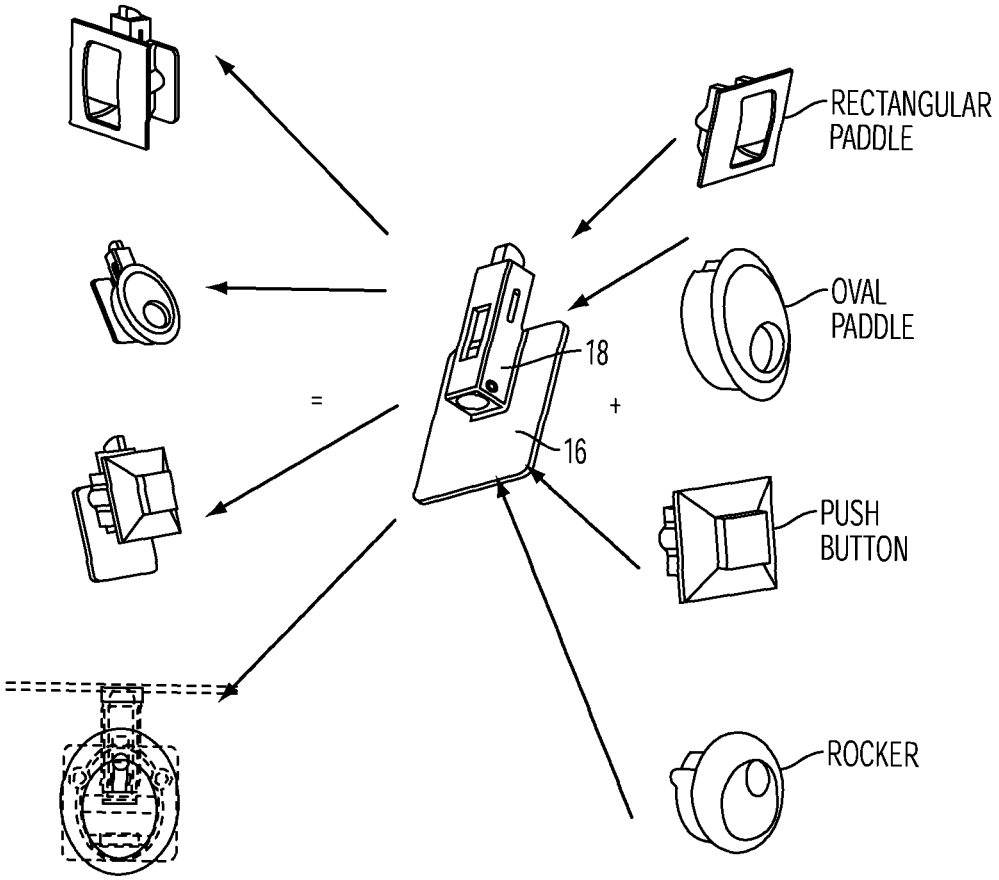
FIG. 6 shows many of the different configurations of the invention, all based on the same bolt mechanism assembly while having different actuator housing assemblies. Each of the actuator housing assemblies shown can be attached to the same bolt mechanism assembly.
Figure 7:
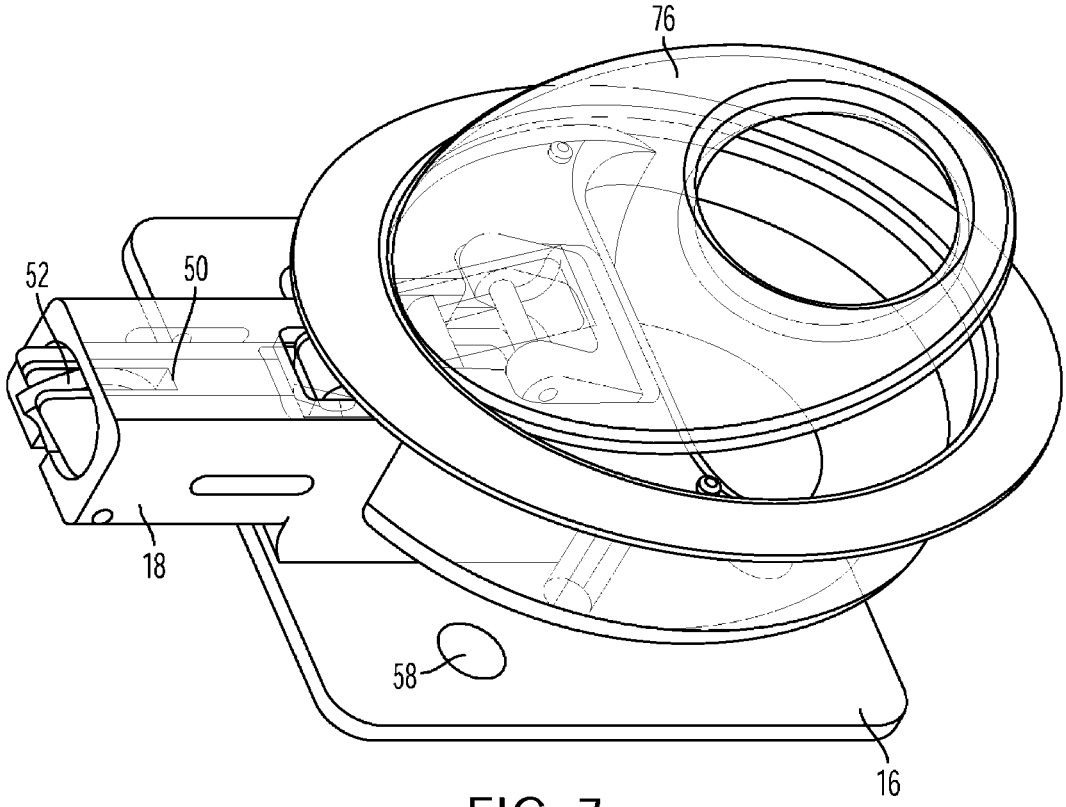
FIG. 7 is an enlarged perspective view of the embodiment of FIG. 3G prior to being screwed together and mounted on a panel with the oval actuator in the raised or open position.
Figure 8:
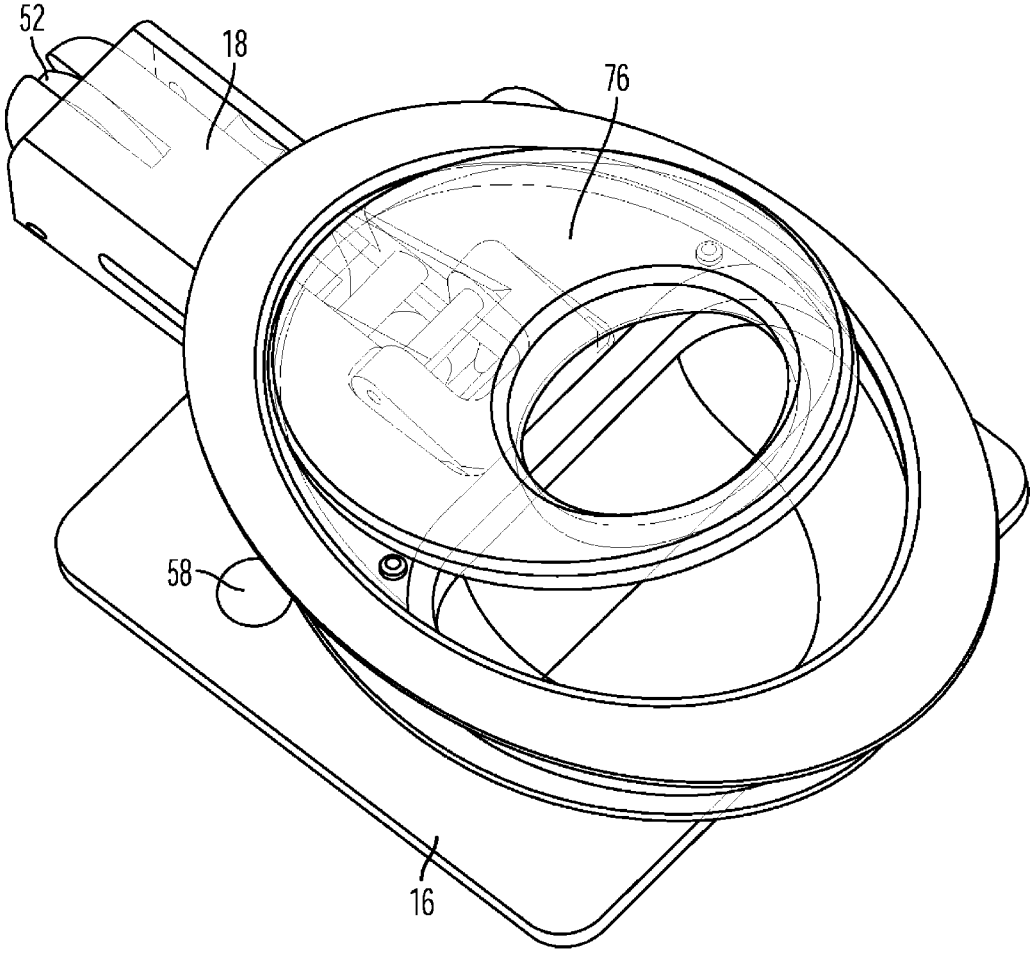
FIG. 8 is the same device as FIG. 7 with the viewing angle shifted approximately 90° to the right.

The closure latching assembly may also contain dual bolt mechanism assemblies assembly and an actuator housing assembly having side-by-side paddles, as shown in FIGS. 4A and 4C. The construction and operation of the bolt is essentially the same as is discussed above in connection with the embodiment of FIGS. 3A to 3F.

Turning to FIGS. 5A to 5E, the closure latching system of FIGS. 1A to 1F can also be modified to operate a pair of spaced apart side latches 82, providing three point latching. This is accomplished by the having two side openings 84 in the bolt housing 18. Linkages 86 connect the bolt with the two side or spaced apart latches 82 such that movement of the bolt to open the center latch also functions to open the two side latches.

The Bolt Mechanism Assembly

The bolt mechanism assembly is preferably comprised of a housing 18 in the form of extruded T shaped extrusion carrying a bolt assembly including the bolt 20 and the spring 40 and is self contained. An upper bolt pin 46 intersects and press is fitted to the bolt assembly and travels along slots 48 in the housing 18. At the bottom of the housing 18 spring retaining pin 42 keeps the spring 40 captured within the bolt housing 18.

The Bolt Mechanism Assembly Housing:

The housing 18 has a square hole along its length to allow the bolt 20 to slide. The flat part of the T on the housing 18 forms plate 16 which is secured with screws to the actuator housing assembly 12 when installed on to the panel 14 through two counter sunk holes 58 that line up with the actuator housing threaded holes 76. A window or access opening 34 is provided in the wall of the housing 18 opposite the backing plate 16 to allow the hammer 30 to advance.

The Bolt Assembly:

The sliding bolt 20 is a square rod with a determined length and a 45 degree beveled edge. In the cam assist embodiments, the bolt end comprises space to accommodate the pivotally mounted cam 52 that assists the initial pushing down of the bolt 20 when the panel 14 is closed against the striker 24. The cam 52 rotates in the fork 50 about cam pin 54. The cam 52 is preferably made of plastic to reduce noise during opening and closing.

Final Assembly

The bolt assembly is accomplished by inserting the spring, then the bolt assembly, installing the upper bolt pin 46 through the slot 48 just below the cam assist device and installing a cam retaining pin 54 to support the cam 52 assist device.

The shape and length of the extrusion and bolt may vary to accommodate the esthetic shape or function of the particular latch actuating housing assembly or to accommodate the placement of the latch with respect to the striker.

Actuator Housing Assembly

The actuator housing assembly is the part of the closure latching system that can vary in shape, esthetic preference and in the function for actuation.

The bolt mechanism assembly is designed to be used with any actuator housing assembly style, esthetic look or design with few changes to accommodate attachments or length of bolt. The same mechanism can be used with many latch assemblies, differing only in appearance. The actuator housing assembly provides for many styles, for example; a push button latch application, a rocker latch application, a paddle or lever style application, but is not limited to these applications. The actuator housing is the portion of the latch that is visible to its operator and can be designed in many forms and functions for each of the style applications. The esthetic designs for the actuator housing are many, and include finger grips formed therein or attached thereto having shapes that are oval, square, rounded, oblong, geometrical in shape or that are formed with a non-conforming shape and/or surfaces.

The objective of the closure latching system is to allow flexibility of design, ease of assembly and simplification of manufacturing. This present invention provides the freedom to design a line of latches that is variable in appearance, function and style. Having the system designed in two parts as mentioned above allows an economic way to manufacture many styles having a variety of appearances. The invention provides for the changing of actuator housing assembly to accomplish any desired change in appearance.

In the paddle embodiment of the invention, the underside of the paddle is preferably provided with rubber or silicone bumpers to eliminate noise from vibrations common in transportation vehicles.

When the bolt activating pin 36 is tightly received in a lateral hole in bolt 20, the rotatable sleeve 38 is provided so that it can rotate around the pin under hammer pressure. Alternatively, the bolt activating pin 36 can be slightly smaller in diameter than the lateral hole in the bolt so that the pin itself can rotate under hammer pressure, in which case the sleeve is not necessary.

This invention can be used for securing of doors, drawers, bins or it can be used for as a restraint system for the marine, household, transportation or the aerospace industries. The latches of this invention can have two, three or more point latching applied to the bolt mechanism while allowing the manufacturer the flexibility of providing esthetically different appearance to the portion of the latch that is visible to the user.

In this invention, the backing plate 16 is preferably an integral part of the bolt mechanism assembly which eliminates the need for and cost to the customer of providing a backing plate.

What is claimed is:

1. A combination comprising a panel and an easily modified closure latching system, said easily modified closure latching system comprising the combination of two discrete assemblies, one being a bolt mechanism assembly having a backing plate and the other an actuator housing assembly, said combination including complementary means extending through said panel attachably and detachably joining said backing plate of said bolt mechanism assembly to said actuator housing assembly, said panel being adapted to be received in a frame having a striker, said bolt mechanism assembly comprising:

said backing plate adapted to be mounted on a complementary surface of said panel, a bolt mechanism assembly housing attached to said backing plate, a sliding bolt assembly carried by said bolt mechanism assembly housing, said sliding bolt assembly being received in said panel, said sliding bolt assembly including a bolt having at one end a cam adapted to extend from an edge of said panel and engage and latch to said striker, said bolt having an actuating pin extending laterally therefrom, a spring in said bolt mechanism assembly housing for biasing said end of the bolt having said cam out of said bolt mechanism assembly housing to latch to the striker, said bolt mechanism assembly housing including passage access for a hammer adapted to compress said spring and withdraw said end of the bolt having said cam to unlatch said cam from said striker; and said actuator housing assembly comprising:

an actuator housing having an opening therein, a movable rocker actuator member received in said opening, said movable rocker actuator member having a front digitally accessible surface and a rear surface adapted to face said panel and being digitally inwardly movable in said opening, said rocker actuator member being carried adjacent one of its ends by said actuator housing about a pivotal connection and being digitally inwardly movable at its other end in said opening about said pivotal connection, the hammer being rigidly affixed to and extending at about a right angle from said rear surface of said movable rocker actuator member, said hammer having a ramp at its free end adapted to compress said spring by contact with said laterally extending actuating pin on said bolt upon inward movement of said rocker actuator member to withdraw said bolt sufficiently into said housing to unlatch said cam from said striker.

2. The combination of claim 1 wherein said actuating pin on said bolt is snugly received in a hole in said bolt.

3. The combination of claim 2 wherein said actuating pin carries a sleeve rotatable by contact with said hammer about said actuating pin upon inward movement of said rocker actuator member.

4. The combination of claim 1 wherein said backing plate extends beyond said housing.

5. The combination of claim 1 wherein said bolt mechanism assembly housing is integrally formed with said backing plate.

6. The combination of claim 1 wherein said complementary means includes screw holes in said backing plate on said bolt mechanism assembly and screw receiving openings in said actuator housing assembly, and screws that are received in said holes and are held by said openings.

* * * * *